US007196257B2

(12) United States Patent
Swick et al.

(10) Patent No.: US 7,196,257 B2
(45) Date of Patent: Mar. 27, 2007

(54) COMPUTER AIDED PIANO VOICING

(75) Inventors: Andrew Swick, Houston, TX (US); Douglas Duncan, Houston, TX (US); Darius Roberts, Houston, TX (US); Shannon Hughes, Houston, TX (US)

(73) Assignee: William Marsh Rice University, Houston, TX (US)

( * ) Notice: Subject to any disclaimer, the term of this patent is extended or adjusted under 35 U.S.C. 154(b) by 470 days.

(21) Appl. No.: 10/736,193

(22) Filed: Dec. 15, 2003

(65) Prior Publication Data

US 2004/0182227 A1 Sep. 23, 2004

Related U.S. Application Data

(60) Provisional application No. 60/433,511, filed on Dec. 13, 2002.

(51) Int. Cl.
*G10H 7/00* (2006.01)

(52) U.S. Cl. ..... 84/460; 84/622; 84/692

(58) Field of Classification Search ..... 84/460, 84/626, 627, 697–701, 622, 692
See application file for complete search history.

(56) References Cited

U.S. PATENT DOCUMENTS 5,423,241 A 6/1995 Scarton et al. ..... 84/454
5,537,862 A 7/1996 Scarton et al. ..... 73/82
5,710,713 A * 1/1998 Wright et al. ..... 702/23
5,983,087 A * 11/1999 Milne et al. ..... 455/149
6,609,074 B2 * 8/2003 Shteinhauz ..... 702/75
2004/0205403 A1 * 10/2004 Markow et al. ..... 714/30
2005/0022987 A1 * 2/2005 Green et al. ..... 166/250.17

OTHER PUBLICATIONS

Internet article entitled "Reyburn CyberTuner is computer software that turns a laptop computer into the most advanced visual tuning device ever created for tuning pianos," Jan. 27, 2004, http://www.reyburn.com/cybertuner.html.
Complete book entitled "Signal Processing & Linear Systems," by B.P. Lathi, 1998.

* cited by examiner

*Primary Examiner*—Lincoln Donovan
*Assistant Examiner*—David S. Warren
(74) *Attorney, Agent, or Firm*—Conley Rose P.C.

(57) ABSTRACT

The present invention discloses a method for determining an optimal piano hammer felt voicing technique for voicing an unvoiced tone in a piano so as to achieve a predetermined standard of tonal quality associated with a given voiced tone using a computer program. The method comprises a) creating a library comprising at least two records wherein each record comprises a transfer function and a voicing technique wherein said transfer function mathematically expresses the effect upon tonal quality of said voicing technique; b) determining the harmonic profile for each of said unvoiced and voiced tones; c) identifying the record in said library that contains the transfer function that is most similar to the voiced transfer function that would be calculated from the harmonic profiles of said unvoiced and voiced tones; and d) disclosing the voicing technique that is contained in said identified record.

28 Claims, 1 Drawing Sheet

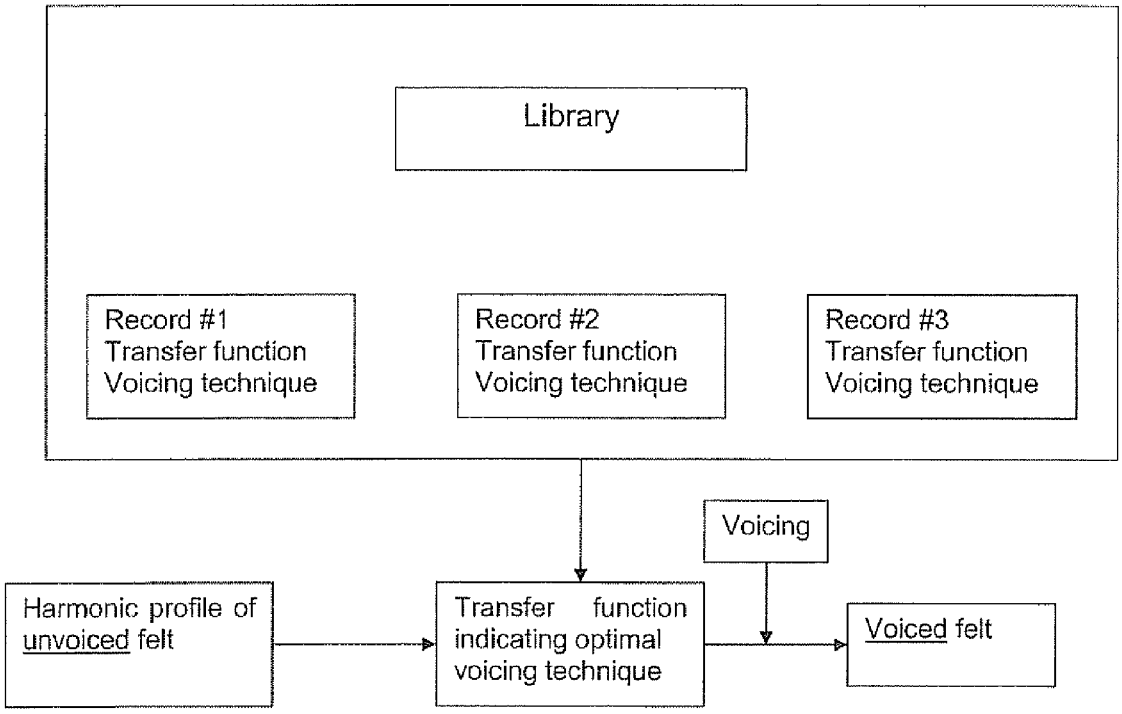
Library
Record #1
Transfer function
Voicing technique
Record #2
Transfer function
Voicing technique
Record #3
Transfer function
Voicing technique
Voicing
Harmonic profile of unvoiced felt
Transfer function indicating optimal voicing technique
Voiced felt

COMPUTER AIDED PIANO VOICING

CROSS-REFERENCE TO RELATED APPLICATIONS

The present application claims the benefit of U.S. Provisional Patent Application Ser. No. 60/433,511 filed Dec. 13, 2002, and entitled Computer Aided Piano Voicing.

STATEMENT REGARDING FEDERALLY SPONSORED RESEARCH OR DEVELOPMENT

Not applicable.

FIELD OF THE INVENTION

The present invention relates to a method for adjusting the tonal quality of an harmonic acoustic signal from a musical instrument. Particularly, the present invention relates to a method for obtaining a desired tonal quality of at least one note from a musical instrument, preferably a piano. More particularly, the present invention discloses a method for determining an optimal voicing technique for voicing a unvoiced tone to achieve a preferred standard of tonal quality for a piano note using a computer program.

BACKGROUND OF THE INVENTION

A musical instrument produces an harmonic tone by establishing a standing wave in a resonator, defined herein as a chamber or medium within which a standing wave can be established. The standing wave vibrates at a frequency determined by three separate factors: the medium through which the wave propagates; the length of the resonator; and the conditions at the boundaries (ends) of the resonator. The vibrations in the resonator give rise to a soundwave of comparable frequency that travels through the air to a listener where it is detected as a tone. All tones, both harmonic and pure, are defined by a fundamental frequency $v_0$. Musical notes are harmonic tones and as such consist of components at frequencies that differ from the fundamental frequency; commonly known as overtones or harmonics. The frequency for each harmonic bears a mathematical relationship to the fundamental frequency that characterizes a given tone. Specifically, each harmonic exists at a frequency that is some positive whole number multiple of the fundamental frequency. The harmonic series, the sequence of all harmonics including the fundamental frequency, indicates the mathematical relationship between the harmonics and will depend upon the character of the resonator. In particular, it is the type of resonator and the boundary conditions of said resonator that dictate the harmonic series. For example, the harmonic series for a vibrating string fixed at both ends is $2v_0$, $3v_0$, $4v_0$, etc. where $v_0$ is the fundamental frequency.

Different musical instruments produce tones that share a common fundamental frequency yet are notably different in their tonal character. This difference in tonal character is described as timbre ('tam-bar) and is ascribed to the different harmonic profiles that accompany the fundamental frequency for a given tone. The harmonic profile may be defined herein as a collection of data for audible harmonics including, for example, pitch, volume, inharmonicity and sustain time; the contribution of each having potential effects upon tonal quality. The tone associated with a given musical instrument has a characteristic harmonic profile. It is the difference in the relative contributions among the harmonics for a given note that differentiates one instrument from another. Thus, an A note having a fundamental frequency of 440.00 Hz sounds markedly different if played on a piano or a trumpet.

The timbre of a harmonic tone (though not the pitch) is dependent upon the strength, pitch and length of each harmonic and changes in these factors give rise to subtle changes in the timbre of an harmonic tone. The practice of altering the individual harmonics of a tone to effect a desired tonal quality is referred to as voicing. It is important to appreciate the distinction between tuning and voicing. Tuning of a musical instrument is the correction of pitch in generated tones such that the fundamental frequencies for generated tones is coincident with frequencies that have been established for each tone, the tones corresponding to notes of a musical scale. For example, $A_4$, the fourth A note on the piano scale, is defined by convention as having a fundamental frequency of exactly 440.00 Hz. By contrast, voicing is not measured against any such objective standard but involves adjustment of a tone to conform to some preferred voiced. As such, it can vary between musicians and others who appreciate and can discern subtle changes in tonal quality. Descriptions of tonal quality include bright or hard for excessively loud or tinny sounds, and dull or soft for excessively muted or mushy sounds. Tonal quality is readily and permanently adjusted in many instruments by the physical construction of the instrument, qualities of some portion of the resonator, qualities of the performer or some combination thereof.

Inharmonicity is one aspect of tonal quality of relevance to tones generated from pianos. In the piano, the resonator is called a piano string. However, this is somewhat of a misnomer as the piano generates its distinctive sound because the resonator usually comprises a metal wire bound between two fixed ends at high tension. The wire has an associated stiffniess that results in a departure from an ideal harmonic resonator. The resultant wave comprises a degree of inharmonicity, defined here as the extent to which a given harmonic deviates from its predicted frequency. Harmonic frequencies as calculated from an harmonic series are at frequencies that are whole number multiples of the fundamental frequency. One distinctive quality of the piano's sound originates with the inharmonicity present in some harmonics of the tone from the piano.

Tonal quality in the piano is dependent upon the nature of the collision that generates the standing wave in the resonator (piano string). In particular, piano technicians seek to alter the hammer-string interaction in some way to effect desired changes in the tonal quality of the piano. As each of the 88 keys of the piano keyboard is mechanically linked to one hammer, that strikes one, two or three strings of the piano, the adjustment of the hammer, its properties at the striking surface and the manner in which it strikes at least one piano string will directly impact the harmonic profile, and therefore the tonal quality, of each note. Two functions performed by piano technicians seek to attain desirable harmonic profiles by adjustment of some aspect of the piano hammer: regulation and voicing. Regulation concerns the adjustment of the mechanical action of the hammer, levers and counterweights responsible for propelling the hammer into at least one string, the latter concerns the adjustment of the felt that covers the wooden piano hammer.

Manipulating the felt covering of a piano hammer to effect a change in tonal quality is the manner in which the process of voicing takes place in the piano. Voicing of the piano is typically carried out by an experienced piano technician who has developed three key abilities: 1) detection and identification of subtle changes in tonal quality; and 2) familiarity with and ability to execute the requisite voicing procedures upon the hammer felt; and 3) the experience to gauge the predicted effect of a given voicing procedure upon tonal quality. Voicing procedures may be generalized as those that change the hardness of the felt covering in at least one area of the piano hammer. Felt is a fabric that is formed of hair and/or wool fibers that have been interlaced to form a soft, dense fabric. Voicing procedures alter the hardness of the felt by changing the extent to which the fibers of the felt are interweaved; voicing procedures that soften the felt decrease the degree of interweaving while those procedures that harden the felt increase the degree of interweaving. It should be noted that the position on the hammer felt at which voicing procedures can be carried out is not limited to the striking surface of the hammer. For example, hammers that are judged to be too hard are subjected to a process known as needling in which a specialized needling tool often comprising three needles oriented axially within a holder cuts small threads of the tightly wrapped felt. Needling can take place at the striking surface or the shoulders of the hammer felt. For example, a tone that is judged to be hard at predominantly loud volumes (forte) is indicative of a hammer requiring deep-needling at the shoulders. By contrast, a tone that is judged to be hard at soft (pianissimo) volumes is indicative of a hammer requiring shallow needling at the striking surface. Piano hammer felt can also be filed to shape, smooth, and/or remove soft layers of felt to expose harder layers underneath.

The process of voicing a piano tends to be time- and labor-intensive, placing high burdens upon the operator performing the voicing procedure. Typically, a piano technician performing the voicing plays all the notes on the piano several times at varying volume levels to judge the overall tone of the instrument. Individual notes that are judged as being too bright (hard) or dull (soft) are marked as such and the action of the piano is disengaged. The corresponding hammers are voiced, the action of the piano is re-engaged and each note is re-played to judge the effectiveness of the voicing procedures. The process is repeated until an optimal tonal quality is achieved. It is important to note that the piano cannot be played once the action is disengaged. This can require that the technician repeat the cycle of playing the notes, disengaging the action, and voicing the hammers several times before optimal tonal quality can be achieved.

The success of any given voicing procedure is largely dependent upon the ability of the operator to audibly detect any defects in tonal quality present in a given tone, placing a high premium on the hearing ability of the operator. In particular, an operator must have good hearing in the high frequency range to detect the higher harmonics present in a given tone. Because piano technicians typically encounter volume levels approaching the safe-hearing threshold of 120 dB during the course of their work; high-frequency hearing loss is a problem within the art.

There remains a need within the art for piano voicing procedures that are less subjective and more quantitative. Although there exists software in the art that is capable of describing the tonal quality, we are unaware of any method that can properly and quantitatively correlate a desired tonal quality with a given voicing technique. For example, the Pianalyzer of the Reyburn CyberTuner is a software application that displays pitch, inharmonicity, sustain time in seconds and volume for partials 1–16. However, the Pianalyzer does not suggest an optimal voicing technique to achieve a preferred standard of tonal quality. Thus, the voicing of pianos largely remains a process susceptible to inconsistency. Different operators may perceive different aspects of tonal quality and select different voicing techniques. Indeed, the same operator can perceive tonal quality differently from day to day. Across the broad range of piano technicians, there are differences in the exact manner in which voicing procedures are carried out.

For the reasons described above, there exists a clear need within the art of piano technology for methods that make the voicing of piano hammer felt easier, faster, more accurate and more precise. In particular, there remains a need within the art for a method of adjusting tonal quality in pianos in a consistent and exact process that is independent of human error. In addition, there remains a need within the art for voicing procedures that can assist piano technicians in the diagnosis of tones without undue demands upon operator hearing, time or work. Further, there remains a need within the art for voicing procedures that alleviate the burdens placed upon piano technicians.

BRIEF DESCRIPTION OF THE DRAWING

For a more detailed understanding of the invention, reference will be made to the accompanying drawing, which is a schematic illustration of the concepts embodied in the invention.

SUMMARY OF THE INVENTION

The present invention discloses a method for determining an optimal voicing technique for voicing an unvoiced tone to achieve a preferred standard of tonal quality for a piano note using a computer program. The present method comprises a) creating a library comprising at least two records wherein each record comprises a transfer function and a voicing technique wherein said transfer function mathematically expresses the effect upon tonal quality of said voicing technique; b) determining the harmonic profile for each of said unvoiced and voiced tones; c) identifying the record in said library that contains the transfer function that is most similar to the voiced transfer function that would be calculated from the harmonic profiles of said unvoiced and voiced tones; and d) disclosing the voicing technique that is contained in said identified record.

According to one embodiment, the library of the present invention is created by i) digitally recording at least two unvoiced tones and at least one voiced tone and storing said harmonic profiles in a computer program; ii) manipulating the felt of a piano hammer by at least one voicing technique until a voiced tone is achieved and recording a description of said voicing technique in said computer program; iii) calculating the harmonic profile using said computer program for each of said unvoiced and voiced tones; iv) calculating the transfer function using said computer by analyzing the harmonic profiles for one unvoiced tone and one voiced tone; and v) creating a library record comprising a transfer function and a voicing technique.

One feature of the present invention is that it is amenable to customization by individual technicians. As stated hereinabove, voicing technique and style can vary greatly from one operator to the next. The library of the present invention is comprised of at least two, and preferably a plurality, of records. An operator can customize the library to his or her individual needs by, for example, specifying a favored voicing procedure to realize a desired effect upon tonal quality.

DETAILED DESCRIPTION OF THE INVENTION

Definitions

As used herein, the term unvoiced shall refer to a tone for which the hammer felt has not been adjusted to achieve some standard of tonal quality. As also used herein, the term voiced shall refer to a tone that has been adjusted to achieve some standard of tonal quality. It shall be understood that the term voiced may not necessarily refer to a tone that has been adjusted to a most preferred standard of tonal quality. Rather, a voiced tone shall refer to a tone for which the corresponding hammer felt has undergone any alteration to effect any departure in tonal quality from that found in the unvoiced tone. A piano note shall refer to the fullest possible range of tones, including variations in pitch and harmonic profile, associated with the striking of a given piano key. It shall be understood that each key of the piano keyboard can be associated with tones comprising a variety of tonal quality and pitch. A transfer function shall be defined as a frequency-domain representation of a linear, time-invariant filter of a digitized acoustic signal. As used herein, a transfer function processes an input signal to produce a filtered output signal characterized by the selective alteration of at least some portion of the signal. Transfer functions are well-known to those skilled in the art of acoustic signal processing; see, for example, "Signal Processing and Linear Systems" by Lathi, B. P.; Carmichael, Calif., USA: Berkeley Cambridge Press, 1988, incorporated herein by reference. As used herein, an harmonic shall refer to any frequency that comprises a given harmonic tone including the fundamental frequency and any overtones. It shall be understood that although these overtones may be referred to as harmonics, some harmonics may not exactly coincide with the frequencies predicted for such harmonics and may be inharmonic. As used herein, inharmonic or inharmonicity shall refer to a deviance in pitch of an harmonic from the frequency predicted by the mathematical relationships expressed in an harmonic series.

Present Invention

According to one embodiment and as illustrated in the Figure, the present invention discloses a method for determining an optimal piano hammer felt voicing technique for voicing an unvoiced tone to so as to achieve a predetermined standard of tonal quality associated with a given voiced tone vising a computer program. According to this embodiment, the present method comprises a) creating a library comprising at least two records wherein each record comprises a transfer function and a voicing technique wherein the transfer function mathematically expresses the effect upon tonal quality of said voicing technique; b) determining the harmonic profile for each of the unvoiced and voiced tones; c) identifying the record in the library that contains the transfer function that is most similar to a hypothetical transfer function that would be calculated from the harmonic profiles of the unvoiced and voiced tones; and d) disclosing the voicing technique that is contained in said identified record.

Creating a Library

The present method comprises creating a library. As used herein, a library shall refer to a collection of at least two records. Preferably, the library of the present invention comprises more than two records and most preferably said library comprises a plurality of records. The library may take the form of an array of data within a software program.

Although there may be a number of ways to create a library comprising at least one record, a preferred method of creating said library comprises i) digitally recording at least two unvoiced tones and at least one voiced tone and storing said harmonic profiles in a computer program; ii) manipulating the felt of a piano hammer by at least one voicing technique until a voiced tone is achieved and recording a description of said voicing technique in said computer program; iii) calculating the harmonic profile using said computer program for each of said unvoiced and voiced tones; iv) calculating the transfer function using said computer program by analyzing the harmonic profiles for one unvoiced tone and one voiced tone; and v) creating a library record comprising a transfer function and a voicing technique.

According to one aspect, creating said library comprises i) digitally recording at least two unvoiced tones and at least one voiced tone and storing said harmonic profiles in a computer program. Digital recording is well known to those within the art of acoustic, signal processing and piano technology and it shall be understood that a number of equivalent digital recording techniques can be used in the present invention. As used herein, digital recording shall comprise any technique wherein an acoustic signal is segmented into discrete electronic pieces amenable to subsequent signal processing. According to a preferred embodiment, digital recording of tones takes place at a sampling frequency that is of sufficient magnitude to properly resolve the harmonic profile. In particular, it is preferred that a tone be digitally recorded at a sampling frequency that is at least twice the frequency of the highest audible harmonic in the harmonic profile for said tone. According to some embodiments, the tone takes the form of an airborne acoustic signal. In the piano, a vibration is established through the action of the hammer striking at least one piano string. To amplify the resulting soundwave, all the strings of the piano communicate vibrations to a soundboard via a bridge. It is the resulting vibrations in the soundboard that give rise to an airborne acoustic signal that is heard by a listener. According to some embodiments, an airborne acoustic signal is recorded using a flat response microphone. According to alternative embodiments, tones are measured by a detector mechanically engaged in a manner to detect vibrations without causing damping to at least one part of the piano. Exemplary piano parts to which a detector may be engaged include those parts through which the vibrations associated with a tone will propagate such as the bridge, soundboard, string and hammer.

Creating the library of the present invention further comprises manipulating the felt of the piano hammer using at least one voicing technique to achieve a voiced tone and recording a written description of said technique. Although all voicing techniques will change the softness of at least some portion of the piano hammer felt, it shall be understood that operators carrying out voicing operations will vary widely in the exact manner in which such techniques are applied. It is a novel feature of the present invention that the written description of said technique permits for the customization of the created library by individual operators. Suitable voicing techniques may be selected from the group consisting of needling, chemical treatment, filing, steam ironing and any combination thereof. As used herein, needling shall include any technique meant to decrease the extent of interlacing between felt fibers by cutting at least a portion of said fibers. As used herein, chemical treatment shall include the application of any agent, the chemical action of which is capable of altering the extent of interlacing between felt fibers. Exemplary chemical treatments may include, for example, the application of lacquers.

Creating the library further comprises the step of calculating the harmonic profile for each of the unvoiced and voiced tones. It is anticipated that there may be a number of equivalent methods for determining the harmonic profile of an unvoiced or voiced tone. According to one preferred embodiment, the method for calculating the harmonic profile comprises a) calculating the frequency domain spectrum of the tone; b) calculating the power for each frequency in the frequency-domain spectrum; c) determining and identifying the fundamental frequency; d) identifying each harmonic frequency; e) determining the power for each harmonic; and f) determining the degree of inharmonicity for each harmonic. According to an alternate embodiment, the method of calculating the harmonic profile further comprises determining the ratio of the power of each harmonic to that of the fundamental frequency.

According to one aspect, calculating the harmonic profile comprises a) calculating the frequency domain spectrum of the tone. Conceivably, there could exist a number of methods that could be used to convert the analog signal of the tone from a time-dependent spectrum to a form more easily manipulated by a software program. In particular, calculating the frequency-domain spectrum comprises converting the analog acoustic time-domain signal comprising a tone to a digital frequency-domain spectrum. Preferably, the frequency-domain spectrum is calculated using at least one function selected from the group commonly known as Fourier transforms. Suitable Fourier transforms include fast Fourier transforms (FFT), discrete Fourier transforms (DFT), discrete time Fourier transforms (DTFT) and Fourier series. According to a preferred embodiment, a fast Fourier transform is used to calculate the discrete Fourier transform (DFT) of the tone. More preferably, the MATLAB application of the fast Fourier transform is used to calculate the DFT of the tone.

According to another aspect, calculating the harmonic profile for each of said unvoiced and voiced tones comprises calculating the power for each frequency in the frequency-domain spectrum. It is anticipated that there will be a number of equivalent ways to determine the power of each harmonic comprising a tone. Mere deviations from the general method recited herein are included within the scope of this invention. A preferred method for calculating the power for each frequency comprises squaring each coefficient in the DFT spectrum. Preferably, the squared DFT coefficients comprise a vector of power coefficients.

According to yet another aspect, calculating the harmonic profile for each of said unvoiced and voiced tones comprises determining the fundamental frequency. According to some embodiments, the frequency that is identified by the largest power coefficient is identified as the fundamental frequency. In other embodiments, the fundamental frequency undergoes an effective signal broadening as a consequence of certain parameters within the electronics. Indeed, according to one embodiment for determining the fundamental frequency, a spike is found within said vector of power coefficients based upon parameters specified within said software. According to such embodiments, the midpoint of the width of said spike is identified as the fundamental frequency.

According to a further aspect calculating the harmonic profile for each of said unvoiced and voiced tones comprises d) identifying each harmonic frequency comprising said tone. Preferably, each harmonic frequency is identified by determining the multiples from the fundamental frequency and finding the coefficient of maximum power within a specified range from the multiple of the fundamental frequency. Preferably, the multiples from the fundamental frequency are determined by the harmonic series for the resonator. Preferably, said resonator is a string fixed at both ends wherein the harmonic series is $v_0$, $2v_0$, $3v_0$, $4v_0$ and so forth wherein $v_0$ represents the fundamental frequency.

According to another aspect calculating the harmonic profile for each of said unvoiced and voiced tones comprises e) determining the power for each harmonic comprising said tone. In a preferred embodiment, the power for each harmonic is identified after the frequency for each harmonic is determined. In another preferred embodiment, the power for all harmonics including the fundamental frequency are stored within a vector. In yet another embodiment, the ratio of the power of each harmonic to the power of the fundamental frequency is determined.

Yet another aspect of calculating the harmonic profile for each of said unvoiced and voiced tones comprises determining the degree of inharmonicity for each harmonic. As recited hereinabove, the inharmonicity may be defined as the deviance in pitch from the frequencies predicted for each harmonic. In a preferred embodiment, the inharmonicity for each harmonic is calculated and stored within said computer program.

Creating the library of the present invention preferably further comprises calculating the transfer function using said computer program by analyzing the harmonic profiles for one unvoiced tone and one voiced tone. Determination of such transfer functions from acoustic digital signals is well-known to those within the art of acoustic digital signal processing. An representative text on the subject is "Signal Processing and Linear Systems" by Lathi B. P.; Carmichael, Calif., USA: Berkley Cambridge Press, 1988, incorporated herein by reference. The transfer function preferably takes the form of a software program. An exemplary software program presented for the sole purpose of illustrating one embodiment of the invention is included with this disclosure. Although it is anticipated that there could be a number of equivalent computer programs that would be useful in the current invention, a preferred program is written using the MATLAB application.

According to a preferred method of creating the library, at least two records are created and stored in said library. More preferably, a plurality of records is created and stored in said library.

The method for determining an optimal voicing technique further comprises determining the harmonic profile for each of one unvoiced and one voiced tone. According to some embodiments, the harmonic profiles for the tones need not be digitally recorded tones. According to these embodiments, the harmonic profiles may be created electronically or inputted into the software program as a list of data. According to other embodiments, the tones may be digitally recorded and analyzed in a manner substantially similar to that adduced above in describing the creation of the library of the present invention. According to some embodiments of the present invention, the voiced tone need not be an ideal tone. However, in other embodiments, the voiced tone is an ideal tone. As used herein, an ideal tone shall comprise some preferred standard of tonal quality.

The present method for determining an optimal voicing technique further comprises identifying the record in said library that contains the transfer function that is most similar to the voiced transfer function that would be calculated from the harmonic profiles of said unvoiced and voiced tones. Although it is anticipated that there may be equivalent methods for identifying the subject record in said library, one preferred method comprises i) calculating a voiced transfer function from the harmonic profiles of said unvoiced and voiced tones; and ii) comparing the voiced transfer function to each transfer function in said library until the transfer function that is most similar to the voiced transfer function is found. Yet another preferred method for identifying said record comprises i) applying each transfer function in said library to the harmonic profile of said unvoiced tone to generate a harmonic profile for each of said transfer functions; and ii) comparing said harmonic profile of voiced tone to each harmonic profile of said transfer functions until the harmonic profile that is most similar to the harmonic profile of said voiced tone is found.

The present method still further comprises d) disclosing the voicing technique that is contained in said identified record. According to some embodiments, the voicing technique may be disclosed to an operator wherein said operator is the individual performing the piano voicing. According to other embodiments, the disclosure may be in the form of a printed display comprising the voicing technique suggestion. Alternatively, the disclosure of the voicing technique may take place on a computer monitor. According to yet other embodiments, the voicing technique may be disclosed alongside harmonic profile data.

The present computer code is presented as one exemplary embodiment of the invention and is no way to be construed as limiting the present invention. The present invention is limited only to the embodiments and equivalents thereof recited in the claims.

SAMPLE CODE

The following is one example of a computer program used in the practice of the present invention. It is written using the computer application known as MATLAB.

```
ANALYZE.M
% Initializes Variables and Global Constants
initialize;
% Prompts User and Records
y = user_record(Fs,dur);
% Calculates DFT of Recording
x = fft(y);
% Transforms DFT to useful Fourier Coefficients
a2 = transform_to_a2(x, dur*Fs);
% Finds Fundamental Frequency and Power
fund_info = find_fundamental(a2);
% Assembles Array of Power and Inharmonicity for each Partial
freq_info = find_freq_info(a2, fund_info);
% Present the Data {plotting}
%present;
USER_RECORD.M
function y = user_record(Fs, Dur)
%USER_RECORD Prompts user to play and records.
%Prompts User...
'Hit ENTER and Play Note Immediately.'
pause;
%Records and stores in y
y = wavrecord(Dur*Fs, Fs);
TRANSFORM_TO_A2.M
function a2 = transform_to_a2(x, N)
%TRANSFORM_TO_A2 Takes the magnitude of the
Discrete Fourier Transform from the fft.
a2 = zeros(N,2);
% These calculations find the magnitude of the DFT
for k = 1:N
  a2(k) = x(k)*conj(x(k));
end
FIND_FREQ_INFO.M
function freq_info = find_freq_info(a2, fund_info)
%FIND_FREQ_INFO Function assembles array of Partial Information.
global max_partial;
```

-continued

```
freq_info = zeros(max_partial,2);
% Enters Fundamental info in with other Partials
freq_info(1,1) = fund_info(1,1);
freq_info(1,2) = fund_info(1,2);
% Loop Finds info on each partial and assigns it to array
for k = 2: max_partial
  spike_info = find_spike_info(a2, fund_info(1,2), (k-1));
  freq_info(k,1) = spike_info(1,1);
  freq_info(k,2) = spike_info(1,2);
end
FIND_SPIKE_INFO.M
function spike_info = find_power(a2, fund, partial_number)
%FIND_FREQ_INFO Function finds power and inharmonicity of
each partial in the signal.
global inharmonicity_tolerance;
tol = inharmonicity_tolerance + inharmonicity_tolerance *
(partial_number + 1) * (partial_number + 1);
left_boundary = fund * (partial_number +1);
right_boundary = fund * (partial_number + 1) + tol;
max_power = 0;
max_power_index = 0;
for k = left_boundary : right_boundary
  if (a2(k) > max_power)
    max_power = a2(k);
    max_power_index = k;
  end
end
inharmonicity_Hz = max_power_index - fund*(partial_number + 1);
spike_info = [max_power, inharmonicity_Hz];
FIND_FUNDAMENTAL.M
function fund_info = find_fundamental(a2)
%FIND_FUNDAMENTAL Function takes in a
Harmonic signal and returns the Fundamental Frequency
of the series and the power of the Fundamental Frequency.
% Depends on the power settings for the system.
n = 0;
fund_power = 0;
global power_sensitivity;
% Loop cycles through possible piano frequencies, and breaks once
% it finds a frequency for which the power is greater than the
% power sensitivity defined for the system
% n is a frequency <= to the fundamental... but very close
for k=30:1:4000
  if a2(k) > power_sensitivity
    n = k;
    break;
  end
end
% Loop cycles through frequencies near 'n' found above, stops
% before it reaches the first harmonic. Returns the both the
% frequency of the fundamental and the power of the fundamental
% {to avoid double calculation}
for k=n:1:(n+3/2*n)
  if (a2(k) > fund_power)
    fund_power = a2(k);
    fund = k;
  end
end
%returns results
fund_info = [fund_power,fund];
MAKE_LIBRARY.M
function library = make_library(record)
%MAKE_LIBRARY Initializes the library if it does not already
% exist. Record becomes the first entry in the library.
%Example: library = make_library(record1);
library(1).op = record.op;
library(1).transferfunc = record.transferfunc;
library(1).numreadings = 1;
ADD_TO_LIBRARY.M
function library = add_to_library(record, library)
%ADD_TO_LIBRARY(RECORD) Adds record to the library of data,
% either by making the entry corresponding to the technique used
% a weighted average of the old and new functions or by making a
% new entry in the library if this is a new technique.
% Ex. library = add_to_library(record2, library);
%Find length of library
lengthLib = length(library)
%fprintf('%s %d', 'length =', lengthLib)
%Initialize other local variables
```

-continued

```
index = lengthLib+1;
opInLib = 0;
fprintf('%s', 'Got to checkpoint .5')
%Check if record's operation is already in the library.
for k = [1:lengthLib]
  fprintf('%s', library(k).op)
  if((length(record.op) == length(library(k).op)) & (record.op ==
  library(k).op))
    fprintf('%s', 'Got here.')
    opInLib = 1;
    index = k;
  end
end
%If there is already a record for the operation in the library,
%refine it.
if (opInLib == 1)
  library = combine_records(record, index, library);
%If not, add the record to the library.
else
  fprintf('%s','Am trying to add a record.')
  fprintf('%d \n', index)
  library(index).op = record.op;
  library(index).transferfunc = record.transferfunc;
  library(index).numreadings = 1;
end
COMBINE_RECORDS.M
function library = combine_records(record, n, library)
%COMBINE_RECORDS(RECORD, N) Incorporates the data
contained in
%record into the library record at index n (it is assumed that
%these two records contain data about the same voicing operation.
%Make the transfer function stored in library(n) a weighted average
%of the current one and the one in record.
numobs = library(n).numreadings + 1;
library(n).transferfunc = ((numobs-1).*library(n).transferfunc + ...
   record.transferfunc)./numobs;
library(n).numreadings = numobs;
STORE_DATA.M
%STORE_DATA Stores the data obtained in a user-specified file.
%Get user specification for output file
[filename, path_name] = uiputfile('mypiano.mat', 'Save data in');
%Write info to file
save(filename, 'ideal', 'library');
READ_DATA.M
%READ_DATA Reads data about the piano from mat file specified by
%   user
%Get user specification for input file
[filename, path_name] = uigetfile('*.mat', 'Read data from');
%Read info from file
load(filename);
SUGGEST_TECHNIQUE.M
function technique = suggest_technique(input, library)
%SUGGEST_TECHNIQUE Given an input (the output
from freq) and the
% library, suggest which technique in the library would be best
% suited to getting the input to match the ideal.
match = 0;
for k = [1:length(library)]
  output = predict_output(input, library(k).transferfunc);
  matchtemp = comparison(output, ideal);
  if (matchtemp > match)
    match = matchtemp;
    n = k;
  end
end
technique = library(n).op;
PREDICT_OUTPUT.M
function output = predict_output(input, transfunc)
%Predicts the output of a system with transfer function transfunc
%given the vector input.
%Take DFT:
inputspec = fft(input);
%Find output spectrum:
outputspec = inputspec.*transfunc;
%Inverse DFT:
output = normalize(ifft(outputspec));
COMPARISON.M
function compare = comparison(a,b)
%COMPARE Compares two vectors a and b of the same length.
```

-continued

```
% Returns the similarity of the two vectors as a number between -1
% and 1 (between 0 and 1 if the vectors are both positive).
%Normalize vectors:
a = normalize(a);
b = normalize(b);
%Take inner product:
compare = dot(a,b);
NORMALIZE.M
function normal = normalize(a)
%NORMALIZE Scales the vector a to length 1
normal = a./norm(a,2);
FIND_TRANFER_FUNC.M
function transfer = find_transfer_func(input, output)
%FIND_TRANSFER_FUNC(INPUT, OUTPUT) Finds the
transfer function
% needed to produce the given output from the given input.
%Normalize input and output vectors
%Have to, so that volume does not affect our results.
input = normalize(input);
output = normalize(output);
%Take DFTs
inputspec = fft(input);
outputspec = fft(output);
%Divide output by input to get transfer function.
transfer = outputspec./inputspec;
%Normalize transfer function
transfer = normalize(transfer);
```

It shall be understood that the present invention is limited to only what is expressly captured in the claims and that various obvious embodiments are included within the scope of this invention. It shall be further understood that method steps listed in the claims are not to be construed to be in any particular order merely by virtue of their being labeled with sequential numbers or letters in alphabetic order.

What is claimed is:

1. A method for voicing a piano, wherein said method comprises:

a) creating a library comprising at least two records wherein each record comprises a transfer function and a voicing technique wherein said transfer function mathematically expresses the effect upon tonal quality of said voicing technique;

b) determining the harmonic profile for each of the unvoiced tone and the voiced tone;

c) identifying the record in said library that contains the transfer function that is most similar to a transfer function that would be calculated from the harmonic profiles determined in step b);

d) outputting the voicing technique that is contained in said identified record; and e) voicing at least one note on the piano according to the technique output in step d).

2. The method according to claim 1 wherein step a) comprises a) i) digitally recording at least one unvoiced tone and calculating and storing the harmonic profile of said tone in a computer program;

a) ii) manipulating the hammer felt by at least one voicing technique and recording a description of said voicing technique in said computer program;

a) iii) digitally recording at least one voiced tone and calculating and storing the harmonic profile of said tone in said computer program;

a) iv) calculating the transfer function using said computer by analyzing the harmonic profiles determined in steps a) i) and a) iii); and a) v) creating a library record comprising the transfer function from step a) iv) and the voicing technique from step a) ii);

wherein at least two records are created.

3. The method according to claim 1 wherein step a) said library comprises a plurality of records.

4. The method according to claim 1 wherein step c) comprises c) i) calculating a voiced transfer function from the harmonic profiles of said unvoiced and voiced tones; and c) ii) comparing the voiced transfer function to each transfer function in said library until the transfer function that is most similar to the voiced transfer function is found.

5. The method according to claim 1 wherein step c) comprises c) i) applying each transfer function in said library to the harmonic profile of said unvoiced tone to generate a harmonic profile for each of said transfer functions; and c) ii) comparing said harmonic profile of the voiced tone to each harmonic profile generated in step c) i) until the harmonic profile that is most similar to the harmonic profile of said voiced tone is found.

6. The method according to claim 1 wherein said harmonic profile comprises data for pitch, inharmonicity, time length and volume.

7. The method according to claim 1 wherein said harmonic profile comprises data for pitch, inharmonicity and volume.

8. The method according to claim 2 wherein recording a tone takes place at a sampling frequency that is at least twice the frequency of the highest audible harmonic in a tone.

9. The method according to claim 2 wherein in step a) ii) a voicing technique is selected from the group consisting of needling, chemically treating, filing, lacquering, steam ironing, or any combination thereof.

10. The method according to claim 2 wherein recording an unvoiced or voiced tone comprises recording an airborne acoustic signal.

11. The method according to claim 10 wherein recording an airborne acoustic signal is carried out using a flat response microphone.

12. The method according to claim 2 wherein an unvoiced or voiced tone is measured by a detector directly coupled to at least one part of the piano.

13. The method according to claim 12 wherein a part of the piano is selected from at least one of the bridge, soundboard, string, and hammer.

14. The method according to claim 2 wherein each harmonic profile is generated by a process comprising a) calculating the frequency domain spectrum of the tone;

b) calculating the amplitude at each frequency in the frequency-domain spectrum;

c) identifying the fundamental frequency from among the frequencies in the frequency-domain spectrum;

d) identifying the frequency for each harmonic from among the frequencies in the frequency-domain spectrum;

e) determining the amplitude for the harmonic at each of said identified harmonic frequencies; and f) determining the degree of inharmonicity for each harmonic.

15. The method according to claim 14 further comprising determining the ratio of the power of each harmonic to that of the fundamental frequency.

16. The method according to claim 14 wherein step a) said frequency-domain spectrum comprises at least one function selected form the group consisting of Fourier transforms.

17. The method according to claim 16 wherein the Fourier transform is selected from the group consisting of fast Fourier transforms (FFT), discrete Fourier transforms (DFT), discrete time Fourier transforms (DTFT) and Fourier series.

18. The method according to claim 14 wherein step a) comprises calculating the discrete Fourier transform (DFT) using a Fast Fourier transform algorithm.

19. The method according to claim 18 further comprising squaring the DFT coefficient at each frequency.

20. The method according to claim 19 the squared DFT coefficients comprise a vector of power coefficients.

21. The method according to claim 19 wherein step c) comprises finding a spike within said vector of power coefficients wherein said spike is found based on equipment parameters.

22. The method according to claim 21 wherein step c) further comprises identifying the midpoint at the width of said spike as said fundamental frequency.

23. The method according to claim 14 wherein step d) comprises searching for the frequency within a specified range of the necessary multiple of the fundamental, containing maximum power.

24. The method according to claim 14 wherein step e) further comprises storing the power for all harmonics in a vector.

25. The method according to claim 14 wherein steps a) through f) are carried out using a computer software program.

26. The method according to claim 2 wherein step ii) at least one voicing technique is selected from the group consisting of needling, chemically treating, filing, lacquering, and steam ironing.

27. The method according to claim 2 wherein step ii) comprises manipulating the hammer felt at at least one location selected from the shoulders, center or a combination thereof.

28. A method for for voicing a piano to achieve a preferred standard of tonal quality as close as possible to a predetermined voiced tone for a piano note using a computer program comprising a library comprising at least two records wherein each record comprises a transfer function and a voicing technique wherein said transfer function mathematically expresses the effect upon tonal quality of said voicing technique and wherein said method comprises:

a) determining the harmonic profile for each of said unvoiced and voiced tones;

b) identifying the record in said library that contains the transfer function that is most similar to the transfer function that would be calculated from the harmonic profiles of said unvoiced and voiced tones;

c) disclosing the voicing technique that is contained in said identified record and d) voicing a piano according to the technique disclosed in step c).

* * * * *